US005741105A

United States Patent [19]

Schubert et al.

[11] Patent Number: 5,741,105

[45] Date of Patent: Apr. 21, 1998

[54] METHOD OF AND APPARATUS FOR MANUFACTURING TABS FOR EASY-OPEN CAN END

[75] Inventors: James R. Schubert; John F. Schubert, both of Dayton; Steven T. Cook, Bellbrook, all of Ohio

[73] Assignee: Dayton Systems Group, Inc., Dayton, Ohio

[21] Appl. No.: 792,895

[22] Filed: Jan. 31, 1997

[51] Int. Cl.[6] ..... B21D 53/00

[52] U.S. Cl. ..... 413/25; 413/14; 413/16; 413/66; 72/404

[58] Field of Search ..... 413/14, 16, 25, 413/54, 66; 72/404

[56] References Cited

U.S. PATENT DOCUMENTS

| | | | |
|---|---|---|---|
| 3,850,124 | 11/1974 | Brown | 413/25 |
| 4,130,074 | 12/1978 | Cudzik | 413/25 |
| 4,424,698 | 1/1984 | Langseder | 413/14 |
| 4,530,631 | 7/1985 | Kaminski | 413/25 |
| 4,568,230 | 2/1986 | Brown | 413/14 |
| 4,596,342 | 6/1986 | Zysset | 413/14 |

FOREIGN PATENT DOCUMENTS

| | | | |
|---|---|---|---|
| 404033732 | 2/1992 | Japan | 413/25 |
| 406099236 | 4/1994 | Japan | 413/66 |

*Primary Examiner*—Jack W. Lavinder
*Attorney, Agent, or Firm*—Joseph G. Nauman

[57] ABSTRACT

A method and an apparatus are provided for manufacturing a tab for use with an easy-open can end, which tab is free from any exposed protrusion or cut edge thereon that would otherwise contact a finger or a lip of the user, without an increase in the number of manufacturing steps. A tab, attached to a carrier strip by a joint, is formed in a tab forming process, and the tab is severed from the strip in a joint severing process wherein the joint is cut off close to the tab nose to separate the tab from the strip. The tab with a protrusion which has a cut edge, remaining on the tab nose, is lowered while being held against horizontal movement. The protrusion is brought into engagement with a curling surface of an arm which is supported to swing in a downward passage through which the tab descends. When the tab is lowered in the downward passage, the arm is swung to cause the curling surface to press against the tab and curl the protrusion onto the tab.

6 Claims, 9 Drawing Sheets

SEQUENCE
1. (60°) TAB STRIP STOPS
2. (80°) BRIDGE (STRIP) PILOTS ENTER
3. (81.5°) TAB PILOT INTO FINGER HOLE
4. (82°) CUTOFF KNIFE CONTACTS STRIP
5. (85°) TAB CUT LOOSE & TRANSFER PUNCH CONTACTS
6. (141°) TAB LOCATED ON BUTTON & PILOT HITS
7. (144°) BUMPERS CONTACT BELT & TAB INSTALLED
8. (163°) END & TAB INSTALLED ON STAKE PUNCH
9. (165°) STAKE ANVIL CONTACTS TOP OF BUTTON
10. (180°) STAKE COMPLETE

METHOD OF AND APPARATUS FOR MANUFACTURING TABS FOR EASY-OPEN CAN END

FIELD OF THE INVENTION

The present invention relates to a method of and an apparatus for manufacturing a tab mounted on an upper surface of an easy-open can end for opening the can end when it is lifted.

CROSS REFERENCE TO RELATED APPLICATION

This application is related to copending U.S. patent application Ser. No. filed (Docket DSG 004 P2) entitled TABS FOR EASY-OPEN CAN END.

BACKGROUND OF THE INVENTION

Easy-open can ends, which can be opened by lifting and pulling tabs mounted thereon, used on cans for containing beverages, foods, etc., are well known in the art. In recent years retained tab easy-open can ends, which keep the tab attached to the end panel after they are opened, have been the predominant type for beverages. The typical retained tab easy-open can end has an integral rivet projecting upwardly from the end panel, an openable area or tear panel surrounded by a score line of partly discontinuous annular shape, and an operating tab fixed to the end panel by a tongue (island) with a rivet hole that receives the rivet. The tab includes a tip end or nose positioned over a part of the tear panel, and a grip part, usually a ring, disposed on its rear end remote from the tip end. When the grip part of the tab is lifted off the end panel, the tab nose presses a region of the openable area at the score, transferring an upward force to the front edge of the rivet, and causing the initial breaking of the score, often called a "pop". Continued lifting of the tab then causes the tab to pivot at the rivet island hinge applying continued force on the nose to complete the tear panel opening.

A tab for use on such a retained tab easy-open can end is typically manufactured as follows: First, an annular tab blank, which is larger than an actual finished tab, is blanked out of a strip of metal that is unreeled from a metal strip coil. At this time, the tab blank is not completely detached from, but remains partly joined to, the strip by a joint; the strip functions as a carrier. The tab blank is then punched with holes used in forming a tongue, a rivet hole, and a grip ring. The holes may be formed in the strip before the tab blank is punched into of the strip, if desired. Thereafter, the tab blank is formed with a predetermined pattern of convex and concave shapes, and curled along its peripheral edge into a final tab profile. The carrier strip moves the still attached tabs to a station where a tab is riveted to an end panel. The joint is then severed to separate the tab from the strip, while the tab is fixed to a rivet on a can end through the rivet hole in the tongue.

When the tab is severed from the strip, a protrusion is left at a cut edge of the severed joint projecting from an outer edge of the tab. In beverage can end tabs the joint is usually positioned on the grip end, and thus the protrusion is formed on the grip ring when the joint is severed. When the tab is lifted by a finger, the sharp cut edge of the protrusion tends to contact the finger, making the user feel uncomfortable. If, on the other hand, the joint is positioned on the tip end of the tab (as more often used presently on tabs for full panel ends on food cans), then the protrusion is formed on the tip of the tab nose when the joint is severed. If this type of tab is used on beverage cans, when the can end is opened the pouring aperture and tab nose may contact a lip of the user, and the sharp cut edge of the nose protrusion is liable to come into contact with the lip, also making the user feel uncomfortable, perhaps catching on facial hair.

To eliminate the above difficulties, there has been proposed a method of manufacturing a tab by joining a tab blank to a strip with an S-shaped joint, cutting off the S-shaped joint at an end thereof close to the nose, and then curling the severed joint. According to that proposal, any remaining protrusion is curled onto the tab for protection against accidental contact with a finger or a lip. That proposed method, however, is disadvantageous because it is necessary to form the joint into an S shape before the joint is cut off close to the tab nose, so that method involves an increased number of manufacturing steps and major changes in the tab tooling.

Consequently, apparatus for manufacturing a tab according to such proposed method requires a stage for forming the joint into an S shape in addition to a stage for cutting off the joint at the end close to the strip. Also, it is quite difficult to get a punch and opposing die close to the edge of the tab in existing tooling. Furthermore, current pinch score techniques, followed by breaking the tab out of the skeleton carries strip over cut off knives, encounter problems of controlling score depth. If a score is too deep, this can tear up thin tabs or cause premature break outs or defects of metal properties on specifications.

An unsupported rivet island requires less forming stations but has disadvantages of producing higher opening (pop) forces, less tab bends (the number, of successive bends at the tab/island connection before the tab breaks off), and requiring heavier gage material for the same tab strength, as compared to a tab with a structure having a rivet island support. Thus, for such practical reasons current tab types for beverage cans avoid having a nose carrier.

Other problems of attaching the tab in one continuous staking motion create critical timing of tab attaching and rivet head formation, which require in some applications a pre-stake operation and then a final clinch such as a spring loaded stake.

SUMMARY OF THE INVENTION

It is an object of the present invention to provide a method of manufacturing a tab for use with an easy open can end, particularly a beverage can end, which is free from any protrusion thereon that would otherwise contact a finger or a lip of the user, without an increase in the number of manufacturing steps, and an apparatus for manufacturing such a tab without an increase in the number of working stages, with the advantages of a nose carrier strip and a rivet island support structure with a non-rotation feature.

To achieve the above object, the present invention provides a method of manufacturing a tab for use with an easy-open can end, which is fixed to an end panel by an integral rivet and is capable of opening the can end by tearing an openable area (pour panel) along a score on the end panel when the tab is lifted. The method comprises the steps of forming a tab having an island rivet hole which receives the rivet and also having the grip end ring, the tab being joined at its nose to a strip from which the tab is blanked.

Severing the tab from the strip comprises positioning the tab, still attached to the strip, in a tab severing position, cutting off the joint near the tab nose thereby to sever the tab from the strip, and lowering the released tab, which has been formed with a protrusion at the tab nose having a cut edge where the joint has been severed, to the rivet on an end panel. The tab is held against horizontal movement, and the protrusion on the tab nose is contacted by a curved curling surface formed on a distal end of one of a pair of swing arms, which one arm is pivotally supported alongside a downward passage in which the tab is lowered to the end panel. The arm can swing in the downward passage, and its distal or free end is normally urged upwardly by a spring means. Swinging motion of the arm as the tab is lowered presses the curling surface against the protrusion, to curl the protrusion on the tab back against the tab nose.

The tab is attached to the end panel by further lowering the tab following the tab severing step, and after the swing arms move past the pressing position, releasing swing arms from abutment against the tab and allowing the arms to swing upwardly under the bias of the spring means. Then the rivet hole in the tab island is placed over a rivet on an end panel supported in the position to which the tab is lowered, and the rivet is compressed (staked) thereby fixing the tab to the end panel.

Apparatus for carrying out the method according to the present invention comprises a tab forming apparatus (punches and dies) for forming a tab having a rivet hole and also having the grip end or ring. The tab remains connected at its nose by a joint to a strip from which the tab is blanked. A unique tab severing apparatus is provided for severing the tab from the strip at the joint and reforming the protrusion remaining on the nose of the tab. The tab severing apparatus comprises positioning means for horizontally positioning the tab, through movement of the carrier strip, into a tab severing position, and tab lowering means disposed above the positioned tab and being movable for lowering into abutment against an upper surface of the tab while the tab is being held against horizontal movement. The apparatus includes severing means having a cutter movable toward and away from the joint in synchronism with the tab lowering means, for cutting the joint to sever the tab from the strip when the tab is lowered by the tab lowering means. The severing means includes a nip on a slide movable on an angle rather than vertical (which is normal), and the swing arm (described above) which has a curved curling surface on its distal end, projecting into the downward passage. With spring means normally urging the swing arm upwardly, the arrangement is such that the swing arm lowers when the tab is lowered with the curling surface abutting against the protrusion on the tab nose produced when the joint is cut by the nip. The curling surface is of such shape as to curl the protrusion onto the tab nose, spacing the cut edge away from the tip of the nose and into a gap in the nose where the cut edge is guarded.

The apparatus further comprises a can end supporter for holding an end panel with its rivet aligned with the tab rivet hole, in a position to which a tab is lowered by the tab severing apparatus. A staking tool compresses the rivet over a tongue of the tab, around the hole, thereby fixing the tab to the end panel. Therefore, when the swing arm is released from abutment against the tab and moved upwardly by the spring means after the swing arm has moved past the staking position, and when the tab is further lowered by the tab lowering means, the rivet hole in the tongue is fitted over the rivet of the end panel with the island flat against the can end panel. The island also includes a means preventing rotation of the tab on the end panel, as described in further detail in the above-identified related application.

With the method and the apparatus according to the present invention, the joint between the strip and the tab can be severed close to the tab nose, and the resulting protrusion can be curled onto the tab in a sequence of steps carried out by the tab severing apparatus as it lowers the tab from the position at which the tab is severed from the strip. Since the protrusion with its sharp cut edge could make the user feel uncomfortable when contacting the edge a finger or a lip, the protrusion is curled back onto the tab into a shape where the cut edge is guarded and will not contact a finger or a lip of the user. Since the protrusion is curled onto the tab immediately after the tab is severed from the strip, the tab can be manufactured without an increase in the number of manufacturing steps.

A unique feature of the stake station is that the nip off cutter bar is cam driven and its plane of cutting is 50 degrees to the horizontal which allows the carry or joint strip to be cut closer to the body of the tab, e.g. the tab nose. Also the spring loaded transfer punch is arranged to clamp the tab and end before staking the rivet head. The staking tool on the tab lowering means compresses the rivet projecting upwardly through the rivet hole, thus fixing the tab to the end panel.

With the method and the apparatus according to the present invention, therefore, any remaining protrusion at the tab nose can be curled onto the tab and guarded, and also the tab can be attached to the end panel upon descent of the tab from the severing position. Consequently, the tab can be manufactured efficiently by a simple apparatus arrangement without the need for a plurality of additional working stations.

Other objects and advantages of the invention will be apparent from the following description, the accompanying drawings and the appended claims.

DESCRIPTION OF THE PREFERRED EMBODIMENT

Figure 13:
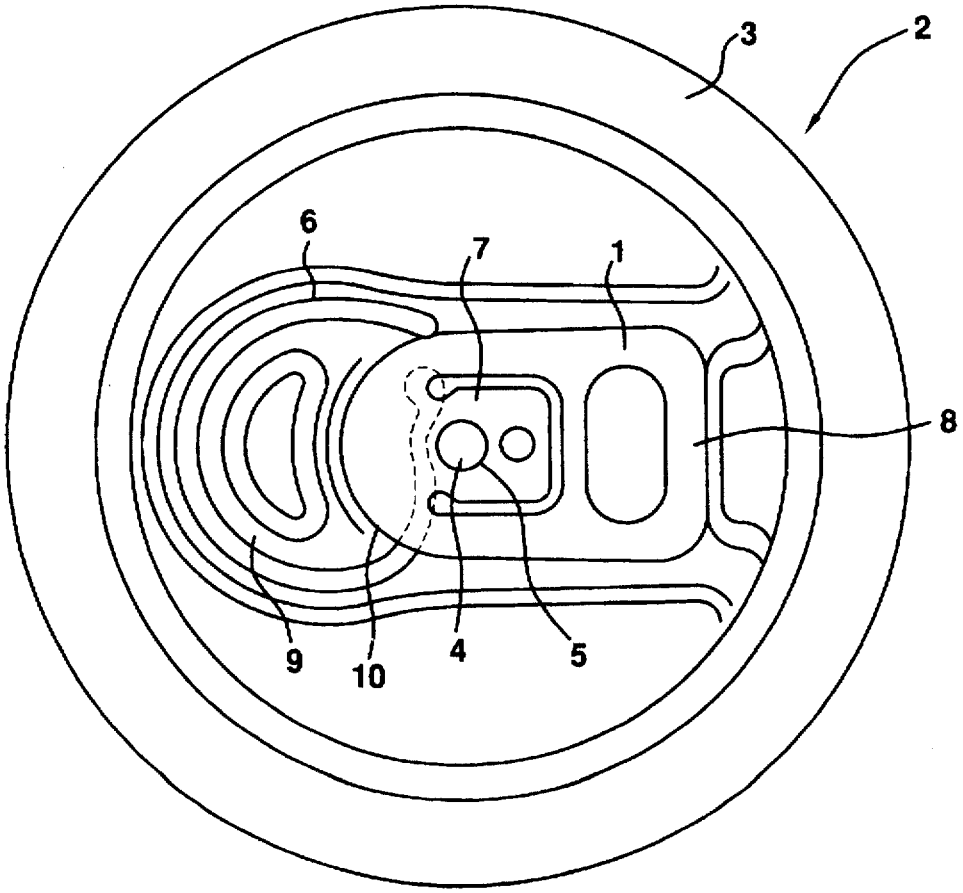
FIG. 13 is a plan view of a can end to which the tab is attached according to the present invention.
Figure 14:
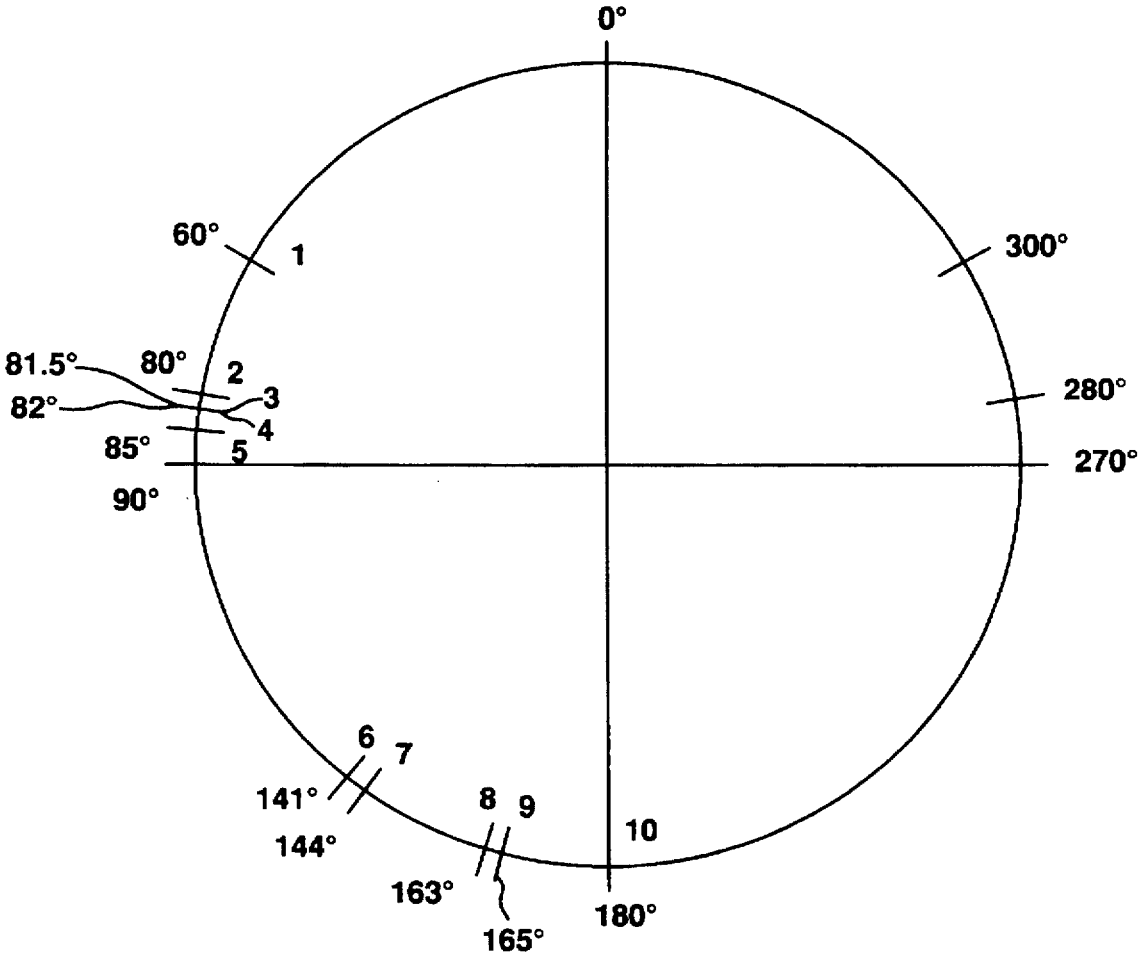
FIG. 14 is a timing diagram for the tab severing, protrusion curling, and attaching steps.

A tab 1 manufactured according to the embodiment of the present invention is suitable for use on a stay-on tab easy-open can end. As shown in FIG. 13, the can end comprises a disk-shaped end panel 3 and a tab 1 mounted thereon. The end panel 3 has a rivet 4 by which the tab 1 is mounted on the end panel 3 and a score 6 which is of a partly discontinuous annular or loop shape and extends along an openable area 9 of the end panel 3 defining a pour panel. The tab 1 has a tongue 7 having a rivet hole 5 in which the rivet 4 is inserted, a grip ring or handle 8 disposed on a rear end of the tab 1, and a tip end or nose 10 positioned on the openable area (pour panel) 9 that is surrounded by the score line 6.

When the grip ring 8 of the tab 1 is lifted off the end panel 3, the nose 10 presses the pour panel 9, separating it along the score line 6. Pour panel 9 is bent toward the product side of the can end 2 about a discontinuous or hinge region of the score 6, thereby to open a pouring aperture in the can end.

A method of manufacturing the tab 1 according to the embodiment of the present invention will briefly be described below with reference to FIGS. 1 and 2. Firsts as shown in the block diagram FIG. 1, the tab 1 is formed by a tab forming process 11, which uses tab tooling punches and dies, not shown. As shown in FIGS. 2A through 2C, as the tabs 1 are formed from a strip 12 of metal unreeled from a metal strip coil, the tabs are joined to the strip by a joint 13. More specifically, in the tab forming process 11, as shown in FIG. 2A, an island tongue 7 is blanked out of the strip 12 and a rivet hole 5 is punched in the strip 12, bend-over tongues 14 for forming a joint 13 and a tip or nose end 10 are blanked out of the strip 12, and a hole 15 for forming a grip ring 8 is punched in metal strip 12. Then, as shown in FIG. 2B, a tab blank 16, which is larger than the actual resulting tab is blanked out of the strip 12. Thereafter, as shown in FIG. 2(C), the bend-over tongues 14 are bent back over the nose leaving a gap 14*a* and the peripheral edge of the tab blank is bent over into conformity with the shape of a tab 1. Now, the completed tab 1 is formed, joined at its nose to the strip 12 by the joint 13. The strip, with tabs attached, is carried to a staking/attaching station in the main tooling of the apparatus.

Figure 1:
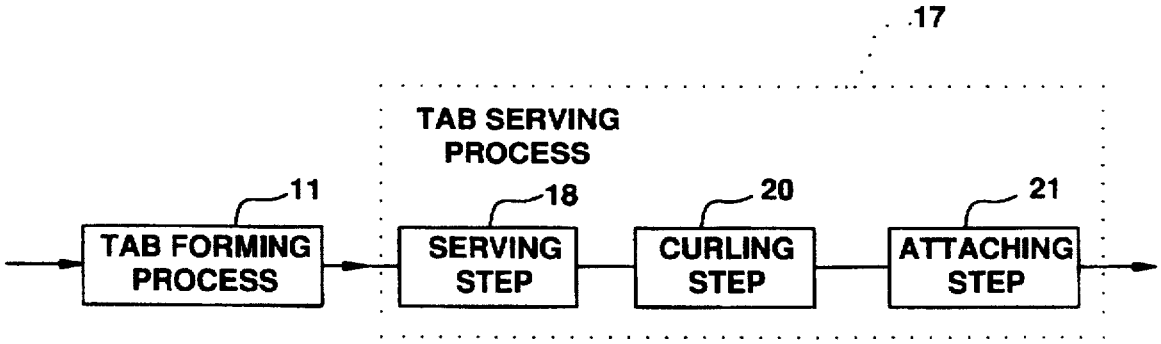
FIG. 1 is a block diagram showing the steps of a method of manufacturing and attaching a tab to a container end according to the present invention.
Figure 2A:
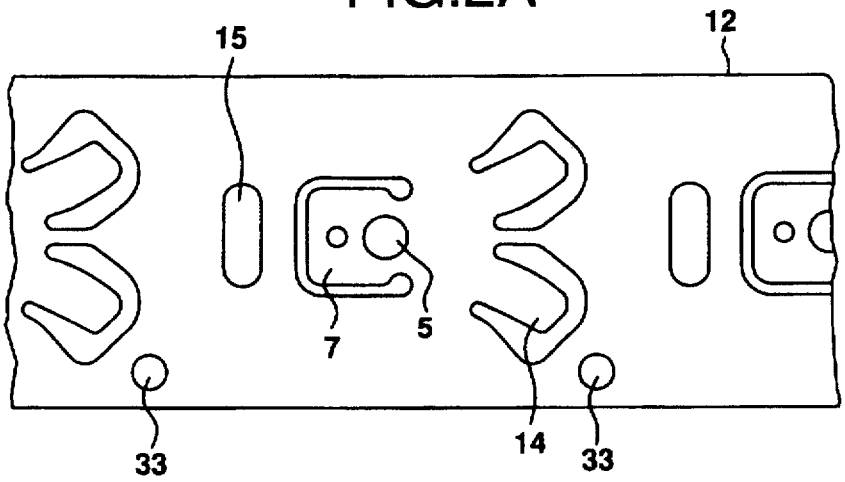
FIGS. 2A, 2B, and 2C are successive fragmentary rear views of a single strip with tabs joined thereto.
Figure 2B:
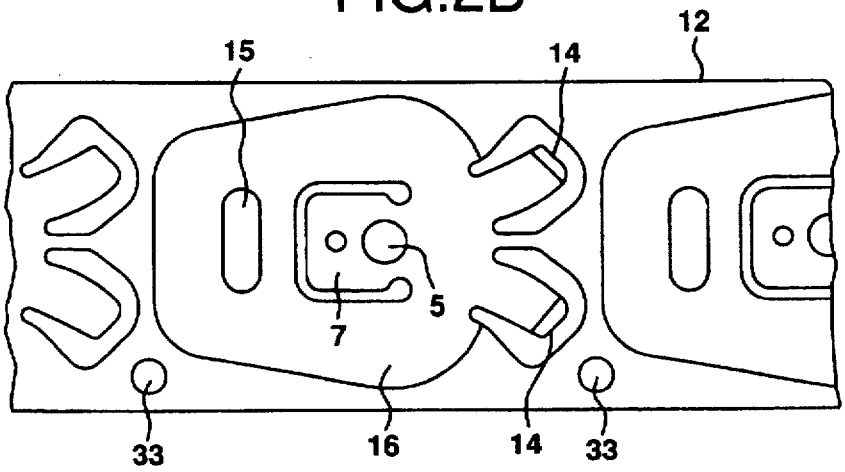
Figure 2C:
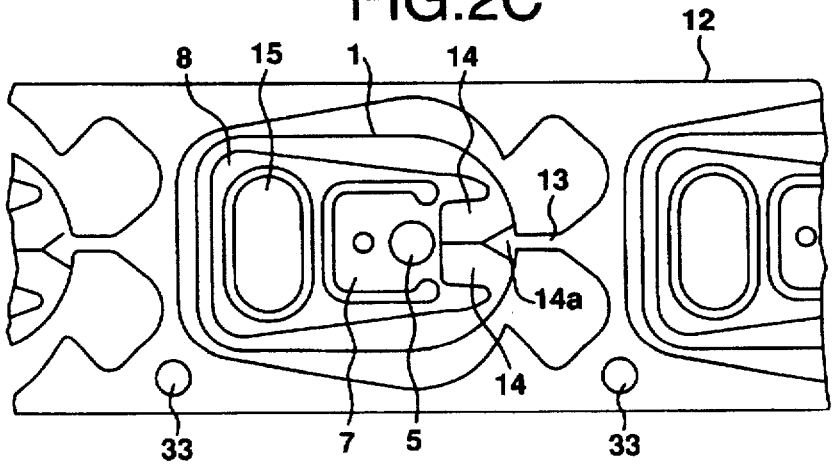

Then, as shown in FIG. 1, a tab 1 joined to the strip 12 is cut off the strip 12 in a tab severing process 17. The tab severing process 17 comprises a succession of steps, namely a step 18 of cutting joint 13, a step 20 of curling a protrusion 19 (see FIG.11A formed on tab nose 10 when joint 13 is severed, and then a step 21 of lowering the tab 1 onto the end panel 3 (FIG. 13) with rivet 4 extending through the rivet hole 5.

A unique tab severing or nip-off apparatus 22 for successively carrying out the steps 18, 20, 21 of the tab severing process 17 is shown in FIGS. 3–10, and comprises a feed path 23 for guiding the strip 12 with tab 1 joined thereto as the strip is advanced intermittently. A vertically movable member 24 which is part of lifting and lowering tooling (not shown), is vertically movable above the feed path 23, and included positioning pilot means 25 for positioning the tabs through connection with strip 12, in alignment with a position for severing the tab 1. A nip-off or severing means 26 will severe a tab carrier joint 13 which has been positioned by the pilot means 25. A tab lowering means 27 will lower a tab 1 which has been severed from strip 12 by the severing means 26. A first swing or pivot arm 28 is movable into abutment against a tab 1 that is being lowered by tab lowering means 27. One or more additional swing arms 29 or movable into position in confronting relationship to the first arm 28, and a can end support 30 is located below supporting an end panel 3 at a position to which a tab 1 is lowered. The various components of the tab severing apparatus 22 are be described in detail below.

As shown in FIGS. 3–10, the feed path 23 is defined between upper and lower guide members 31, 32 which extend parallel to each other. The strip 12 with tabs 1 joined thereto is guided along this path. The positioning or pilot means 25 comprises a pilot pin 34 positioned upstream of the tab severing position and extending downwardly from the vertically movable member 24, and a fixing pin 35 positioned downstream of the tab severing position and extending downwardly from the vertically movable member 24. When the vertically movable member 24 is lowered, pilot pin 34 is inserted through the guide members 31, 32 to position a feeder supporter 50 (described later ) for feeding and supporting the end panel 3. When the vertically movable member 24 is lowered, the pilot pin 35 is also inserted through the guide members 31, 32 and a positioning hole 33 (see FIGS. 2A–2C) in the strip 12. The pilot pin 35 is longer than the fixing pin 35A, and serves to confirm that the end panel 3 has been positioned in place upon insertion in a positioning hole 52 defined in the feeder supporter 50. When the position of the end panel 3 is confirmed by the pilot pin 34, the fixing pin 35, which is shorter than the pilot pin 34, is consequently inserted into the positioning hole 33 in the strip 12 by the lifting and lowering device, thus positioning the strip 12 with a tab 1 joined thereto.

The tab lowering means 27 has a lowering block 36 actuatable by the lifting and lowering mechanism. The lowering block 36 is shorter than the fixing pin 35 and extends downwardly from the vertically movable member 24. The lowering block 36 can be vertically moved through the guide members 31, 32 by the lifting and lowering mechanism. The lowering block 36 has an abutment surface 37 on its lower end for abutment against an upper surface of a tab 1 which is held in the tab severing position. A rod 39 which is vertically slidably supported in the lowering block 36 has an insert 38 on its lower end which projects downwardly from the abutment surface 37 for insertion in the grip ring 8 of the tab 1. The rod 39 is normally urged to project downwardly by a spring 40 housed in the lowering block 36. The lowering block 36 also has on its lower end a presser 41 for pressing downwardly the rivet 4 of the end panel 3 which projects upwardly from the rivet hole 5 when the tab 1 is placed on the end panel 3, as described later on.

The severing means 26 comprises a hardened cutter blade 42 and a slide bar or arm 43 which supports the blade 42 on its distal end. Arm 43 is slidably supported by a guide support 44 such that the blade 42 can move toward and away from a joint 13 of a tab 1 that is placed in the tab severing position. A cam 46, having a cam groove 45 defined therein, is mounted on the vertically movable member 24 near the rear end of the arm 43, for vertical movement by the lifting and lowering device. The support arm 43 has on its rear end a cam follower 47 movable in and along cam groove 45. When the cam 46 is lowered, the cam groove 45 causes follower 47 and arm 43 to move the blade 42 toward joint 13.

The first swing arm 28 has a proximal end pivotally supported on a side of a downward passage in which the tab 1 is movable downwardly by the lowering block 36, the first swing arm 28 being swingable in the downward passage. The first swing arm 28 has a curved curling surface 48 defined in its distal end (see also FIG. 11(A).) for engaging the nose of a tab 1 which has descended from the tab severing position. The first arm 28 is normally urged to swing upwardly by a spring,(not shown) combined therewith. The other swing arms 29 have a proximal end pivotally supported on a side of the downward passage, which confronts the first swing arm 28, the second swing arms 29 being swingable in the downward passage. These are per se conventional. The second-arms 29 have a rear end engaging surface 49 defined in their ends for engaging the rear end of a tab 1 when the nose end of a tab 1 is engaged by the curling surface 48 of the first arm 28. As with the first arm 28, the second arms 29 are also normally urged to swing upwardly by springs (not shown).

The can end support 30 comprises an intermittently advancing feeder support 50 (such as a belt) for feeding end panels 3 to, and supporting the end panels 3, in a position in which a tab 1 is lowered by the lowering block 36, and a lower die 51 which abuts against a lower surface of an end panel 3 which has been fed to and supported in the lowered tab position by the feeder supporter 50. As described later on, the lower die 51 will support end panels 3 from below when a lowered tab 1 is attached to an end panel.

Figure 3:
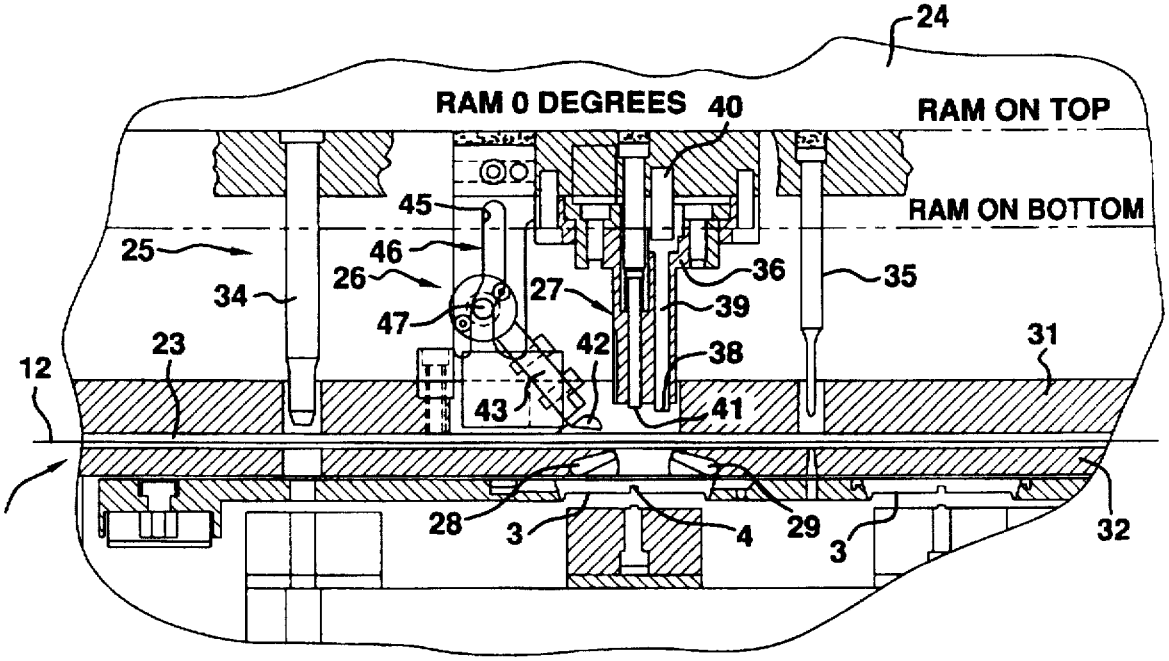
FIGS. 3 through 10 are vertical cross-sectional views of an apparatus according to the embodiment of the present invention, the views showing successive phases of operation of the apparatus.

As shown in FIG. 3, strip 12 is intermittently fed along feed path 23. When a tab 1 arrives at the tab severing position, the vertically movable member 24 of the lifting and lowering device is lowered to insert the pilot pin 34 into the positioning hole 52 in the feeder supporter 50 which feeds the end panel 3, thereby positioning the vertical movable member 24 itself and the feeder supporter 50.

Figure 4:
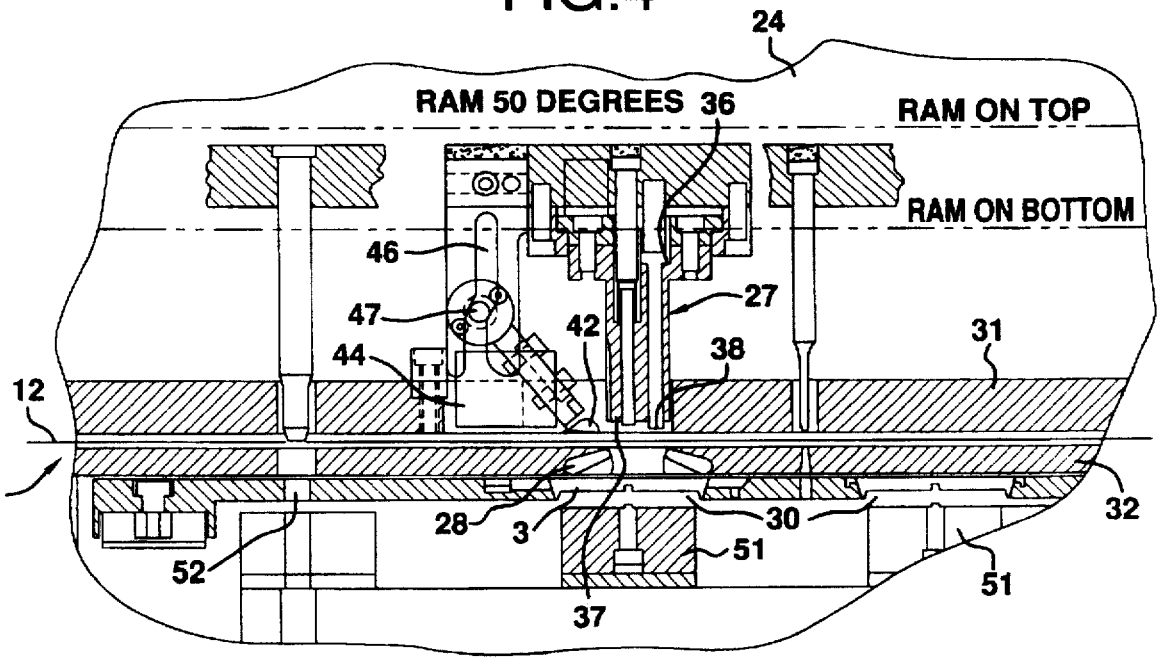
Figure 5:
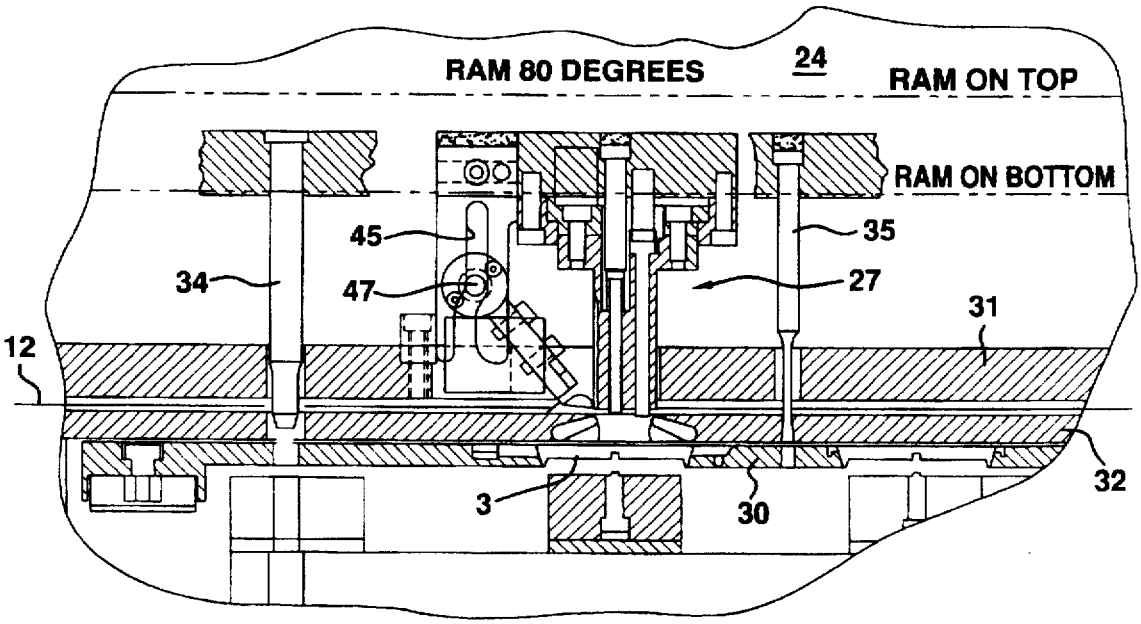

Then, as shown in FIG. 4, the vertical movable member 24 is further lowered to insert the fixing pin 35 into the positioning hole 33 in the strip 12, (see FIG. 2A) thus positioning a tab 1 in the tab severing position. The vertical movable member 24 is lowered until the abutment surface 37 of the lowering block 36 abuts against the tab 1. At the same time, the insert 38 of the rod 39 is inserted in the grip ring hole 15 o the tab 1, and cam 46 of the severing means 26 is lowered. The insert 38 inserted in the grip ring 8 prevents the tab 1 from moving horizontally. The downward movement of the cam 46 causes the cam follower 47 to move along the cam groove 45, causing the support arm 43 to move the cutter blade 42 toward joint 13 of the tab 1. The joint 13 is cut off by the cutter 42, close to the tab nose 10, severing the tab 1 from the strip 12.

After the joint 13 is cut off, a protrusion 19 (see FIG. 11A) having a cut edge of the joint 13 remains attached to the nose 10 of the tab 1. After the severance of the joint 13, the tab 1 is lowered together with the lowering block 36 by the abutment surface 37 of the lowering block 36. The nose end 10 and the protrusion 19 are engaged by the curling surface 48 of swing arm 28, and the rear end of the grip ring 8 is engaged by the engaging surfaces 49 of the second swing arms 29. The tab 1 is kept in a horizontal attitude, without falling by gravity, by engagement with the first and second swing arms 28, 29.

Figure 6:
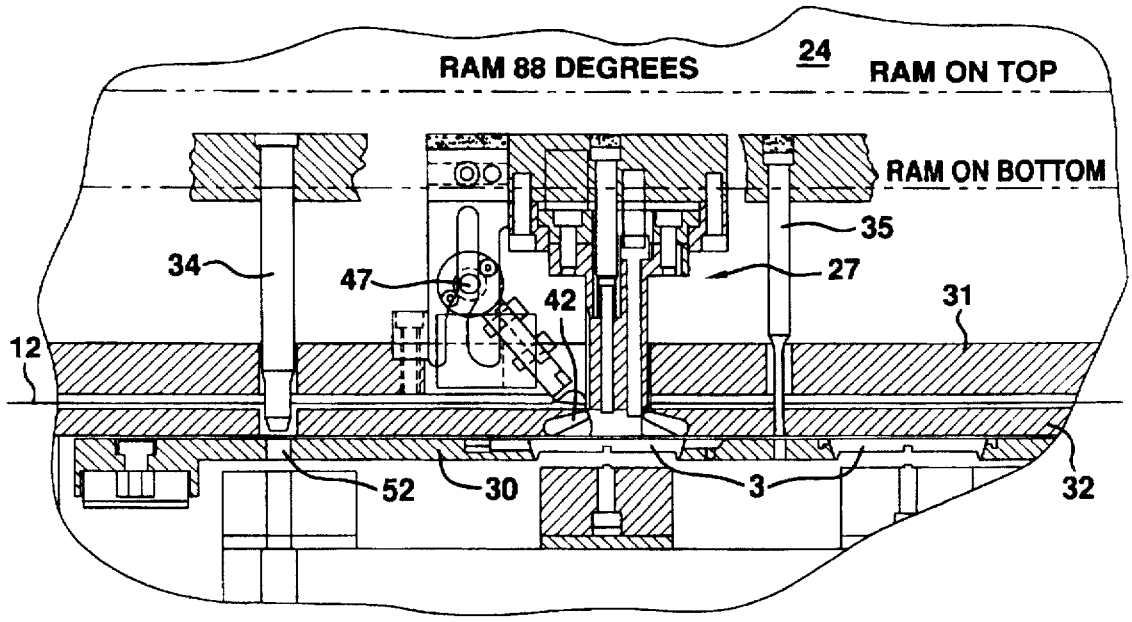
Figure 7:
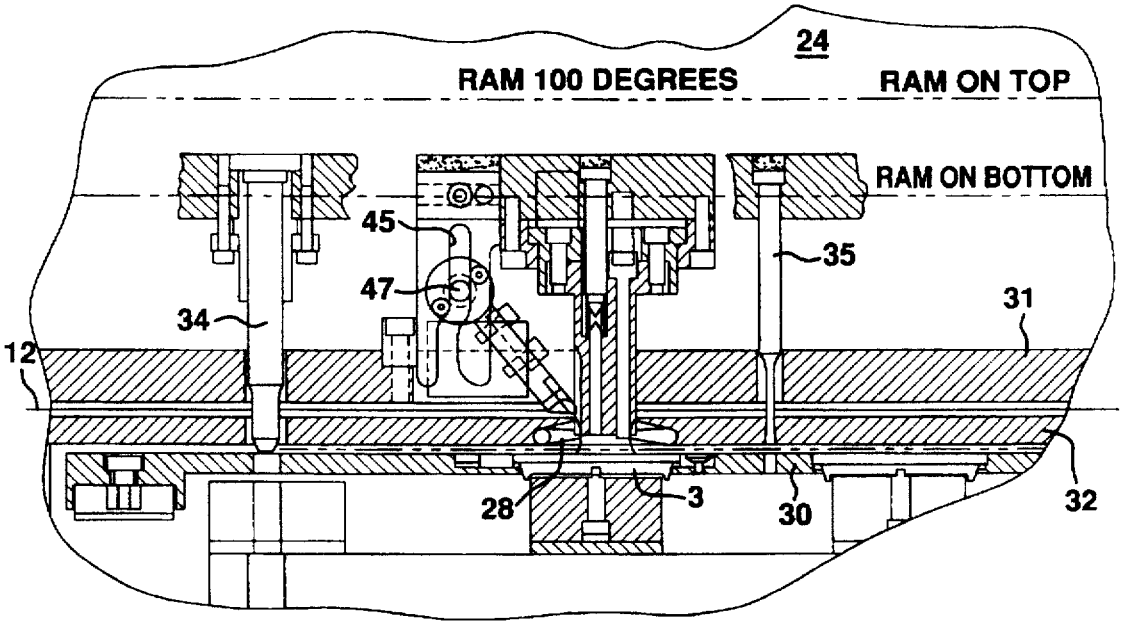
Figure 8:
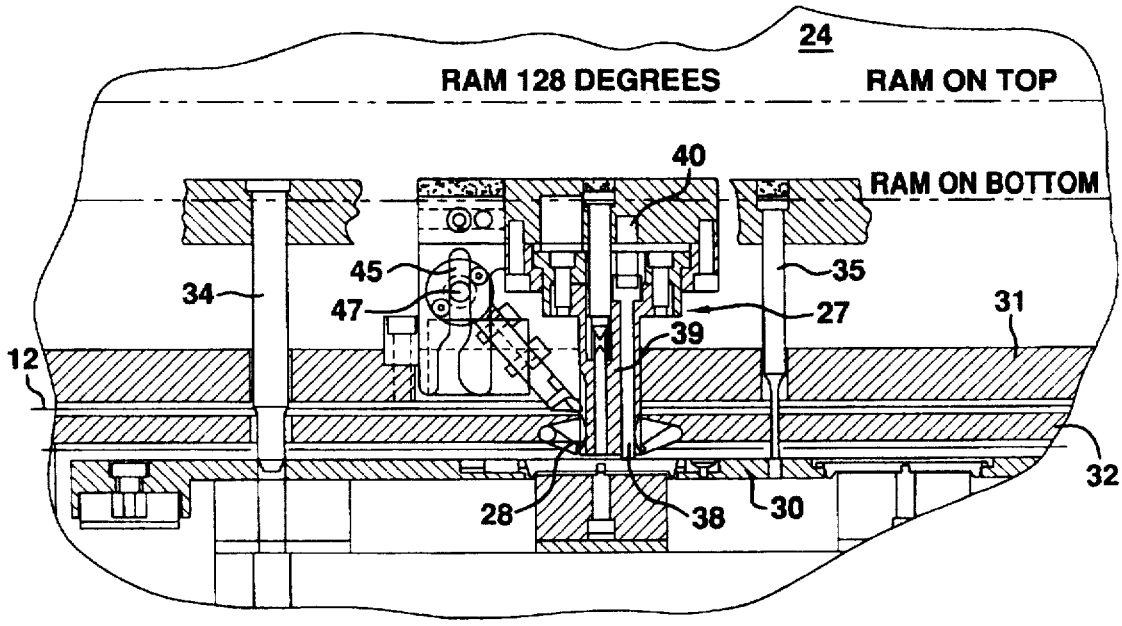
Figure 9:
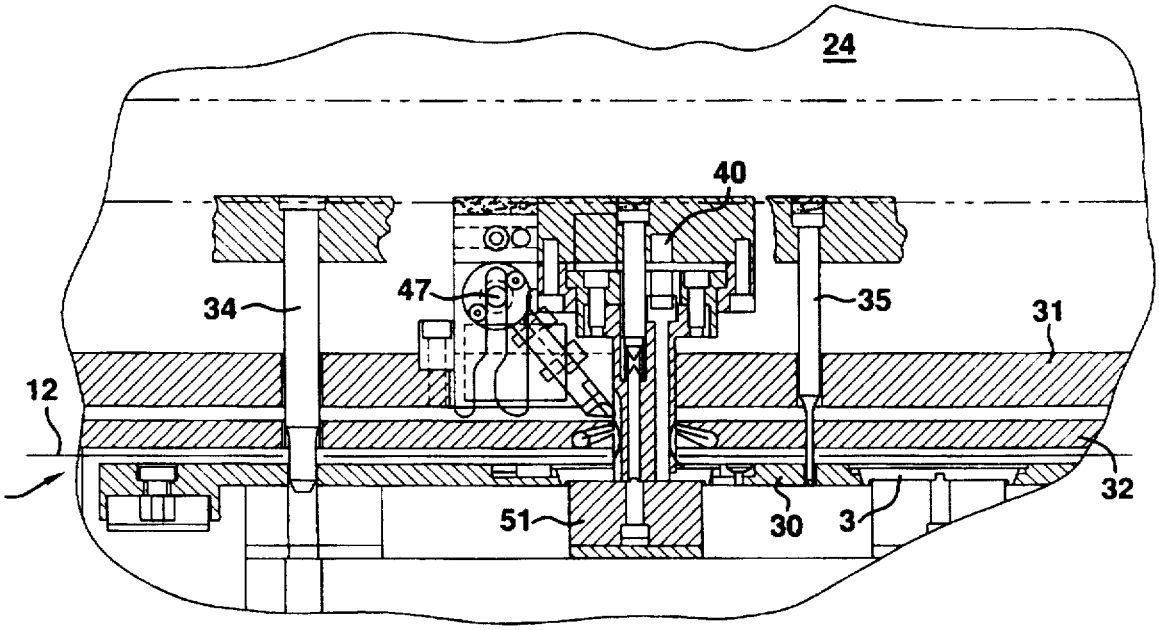
Figure 10:
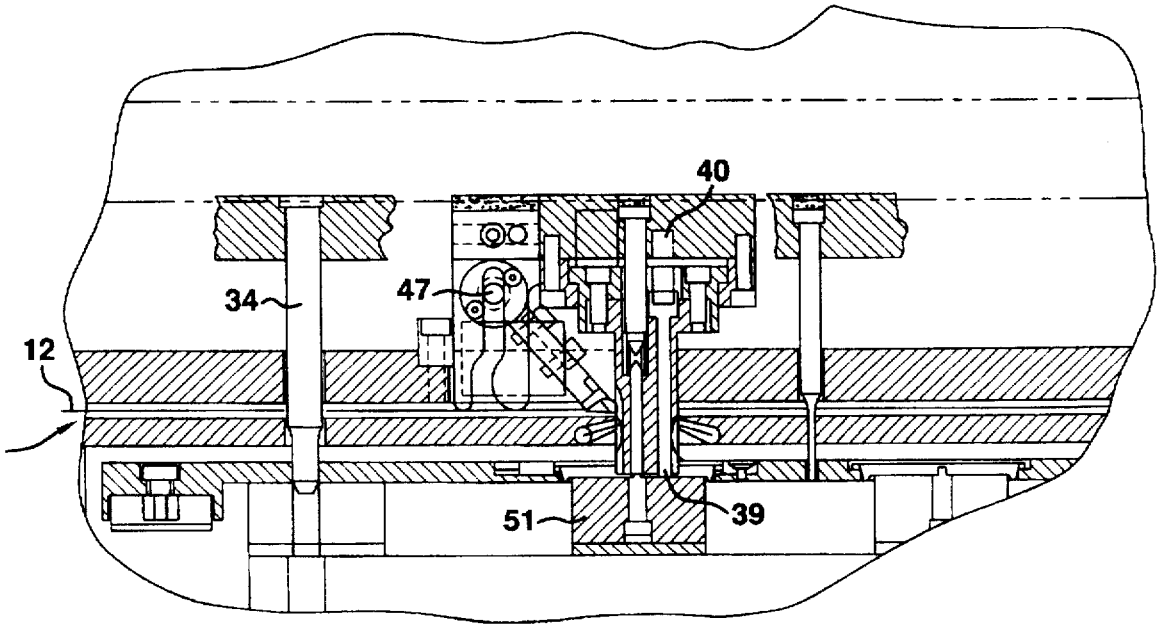
Figure 11A:
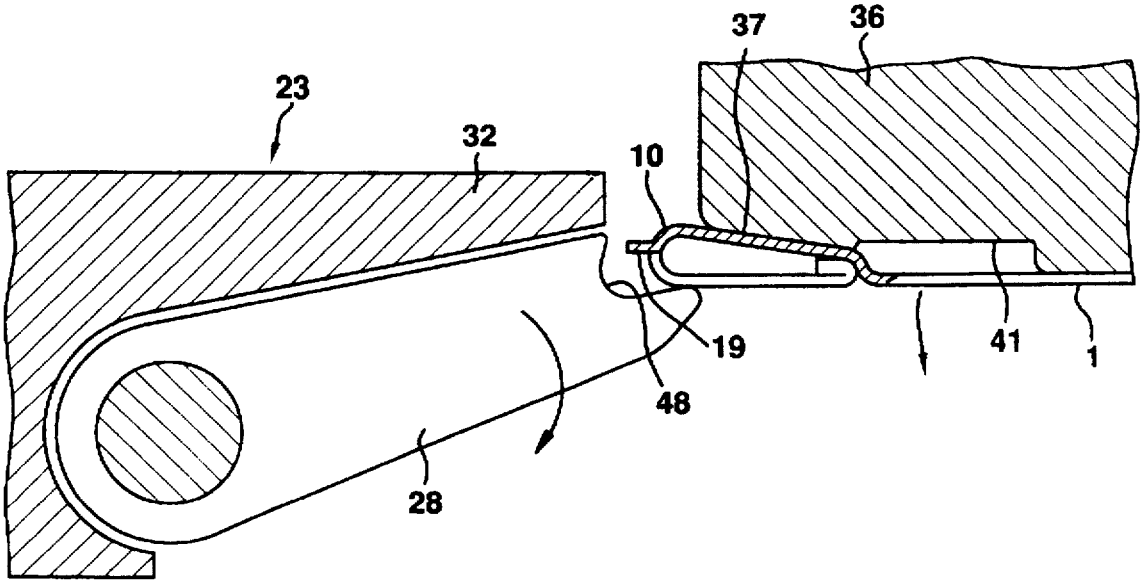
FIGS. 11A and 11B are enlarged views showing the manner in which a swing arm operates.
Figure 11B:
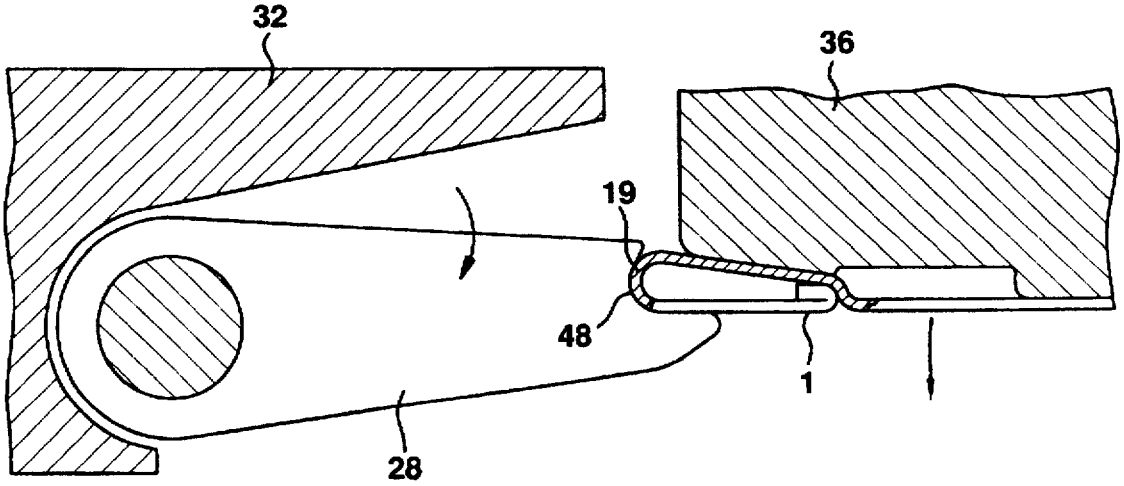
Figure 12:
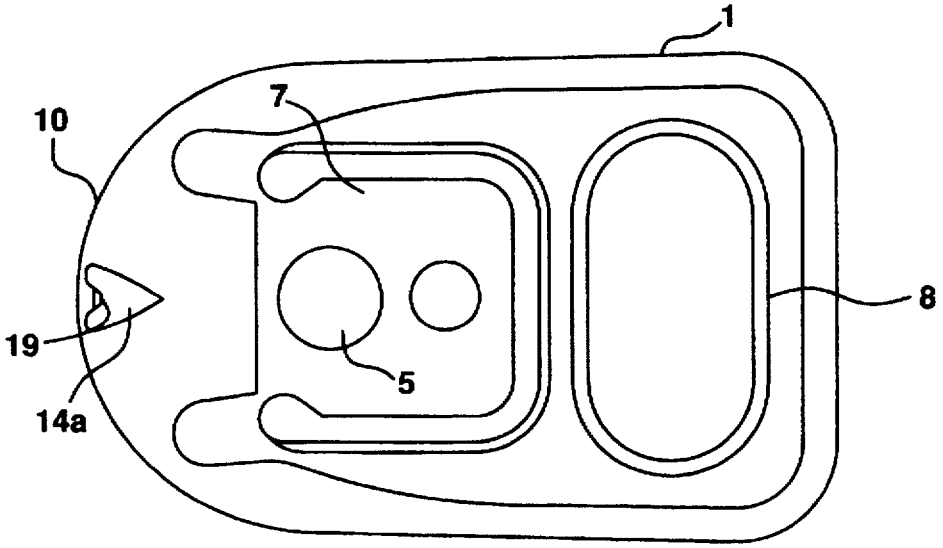
FIG. 12 is a bottom view of a tab manufactured according to the present invention.

As shown in FIGS. 6 and 11A, when the lowering block 36 depresses the tab 1, the first and second swing arms 28, 29 are angularly moved along actuate paths in directions to have their distal ends move toward each other. As shown in FIGS. 6 and 11B, when the first swing arm 28 is angularly moved to a horizontal position, the curling surface 48 is positioned closest to the tab 1, curling the protrusion 19 back onto the tab 1. Therefore, the protrusion 19 is shaped so as not to project from the tip end 10 of the tab 1, and the cut edge is guarded in gap 14*a*. Now, the formation of the tab 1 is completed. As shown in FIGS. 6–9, a completed tab 1 is further lowered by the lowering block 36, and is attached to a end panel 3 which is supported by the feeder support 50. Specifically, the rivet 4 of the end panel 3 is inserted into rivet hole 5 in tongue 7 of a tab 1. The tab 1 has been released from abutting engagement with the first and second swing arms 28, 29, which then were swung upwardly to their original position.

Subsequently, the lower die 51 engages against the lower surface of the end panel 3. The lowering block 36 clamps the tab 1 against the end panel 3. Further downward displacement of the assembly 27 causes the presser 41 (FIG. 10) to compress the rivet 4 that projects upwardly through the rivet hole 5. The tab 1 is now fixed to the end panel 3, as illustrated in FIG. 13.

With the above embodiment according to the present invention, when the vertically movable member 24 is simply lowered by the lifting and lowering device, the tab 1 is cut off from the strip 12 by the severance of the joint 13 in the tab severing position, the protrusion 19 that remains on the tab 1 is curled, and the tab 1 is attached to the end panel 3, altogether in one stroke of downward movement of the vertically movable member 24.

In the illustrated embodiment, the protrusion 19 is formed on the tip end 10 of the tab 1. However, irrespective of the position in which the protrusion 19 is formed on the tab 1, the first swing arm 28 may be positioned in alignment with the protrusion 19, and the protrusion 19 may be curled back onto the tab 1 by the first swing arm 28 thus positioned. Accordingly, wherever the protrusion 19 may be positioned, it is possible to manufacture, with ease, a tab 1 which is free from any protrusion that would otherwise contact a finger or a lip of the user.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A method of manufacturing a tab for attachment by a rivet to an easy-open can end, capable of opening the can end by tearing an openable area surrounded by a score on the end panel when a grip ring is lifted, comprising the steps of:

forming a tab from a strip of materials the tab having a nose end, an island with a rivet hole which receives the rivets and having a grip end at the opposite side of the rivet hole from the nose, the tab being attached at the nose by a joint to the strip; and severing the joint;

said severing step comprising moving the strip to position a captured tab in a tab severing position;

cutting the joint thereby to sever the captured tab from the strip leaving a protrusion having a cut edge from the tab nose;

bringing the protrusion of the tab into abutment against a curling surface on a distal end of a swing arm which has a proximal end pivotally supported on a side of a downward passage in which the tab is lowered, the swing arm being swingable in the downward passage and normally urged to swing upwardly and across the passage by urging means, said arm swinging downward as the tab is lowered; and pressing said curling surface to curl the protrusion onto the tab in a pressing position as the arm is swung downward in the passage to move the curling surface against the tab.

2. A method according to claim 1 further comprising the step of attaching the tab to the end panel by further lowering said tab following said tab severing steps, after said swing arm has moved past said pressing position, releasing said swing arm from abutment against said tab, allowing the swing arm to swing upwardly under the bias of said urging means as the tab passes the arm, thereafter fitting the rivet hole over the rivet of the end panel which is supported in a position to which the tab is lowered, and compressing the rivet against the island thereby to fix the tab to the end panel.

3. A method according to claim 1, further comprising forming tongues at the nose end of the tab, forming bent over tips on the tongues, and folding said tongues to locates the bent over tips at the connection of the island to the nose end of the tab, the region between the tongues providing a gap t the top of the tab nose into which the protrusion cut edge is curled in a guarded condition.

4. An apparatus for manufacturing a tab for use with an easy-open can end, which tab is fixed to an end panel by a rivet on the end panel and is capable of opening the can end by tearing an openable panel area when a grip ring is lifted, comprising:

a tab forming apparatus for forming a tab body having a nose, an island hinged to said body, a rivet hole in said island, and said tab also having a grip end, the tab having a joint at the nose to a carrier strip from which the tab is blanked; and a tab severing apparatus for severing said joint, said tab severing apparatus comprising: positioning means for horizontally positioning the tab with the strip in a tab severing position;

tab lowering means disposed vertically movably above a tab positioned in the tab severing position and movable to lower that tab by abutment against an upper surface of that tab while the tab is being held against horizontal movement;

severing means having a cutter movable toward and away from said joint in synchronism with said tab lowering means, for cutting off the joint thereby to sever the tab from the strip when the tab is lowered a downward extending passage receiving the lowered tab;

an arm disposed below said tab severing position and having a end pivotally supported at a side of said downward passage into which the tab is lowered, said arm being movable in said downward passage;

a curved curling surface disposed on a distal end of said swing arm and projecting into said downward passage; and means for normally urging said arm to swing upwardly, whereby said arm is swung when a tab is lowered by said tab lowering means to locate the curling surface abutting against a protrusion having a cut edge produced when the joint is cut off by said severing means, and said curling surface having a shape such as to curl the protrusion onto the tab nose as the swing arm is swung while the tab is lowered.

5. An apparatus according to claim 4, further comprising:

a can end supporter for supporting the end panel with the rivet aligned with the tab rivet hole in a position below said downward passage to which the tab is lowered by said tab severing apparatus; and a presser on said tab lowering means for compressing the rivet over and about the tab rivet hole thereby to fix the tab to the end panel while said swing arm is released from abutment against the tab and swung upwardly by the urging means.

6. An apparatus as defined in claim 4, said tab severing means further comprising an upper reciprocable tooling member for attachment to a press ram, and a lower tooling member supporting said arm and said downward extending passage;

a nip-off tool supported to have at an angle toward and away from a tab joint to the carrier strip, a follower mounted to said upper tooling member, and a cam cooperating with said follower and connected to control motion of said nip-off tool such that lowering of said upper tooling actuates the severing of a joint to free a tab from the carrier strip.

* * * * *